United States Patent [19]

Winans

[11] 4,209,108

[45] Jun. 24, 1980

[54] DISPLAY ASSEMBLY WITH CARD EJECTOR

[76] Inventor: Eugene P. Winans, 7795 E. Napa Pl., Denver, Colo. 80237

[21] Appl. No.: 892,182

[22] Filed: Mar. 31, 1978

[51] Int. Cl.[2] ..... A47F 3/026; G07F 11/16

[52] U.S. Cl. ..... 221/6; 221/129; 221/155; 221/232

[58] Field of Search ..... 221/6, 129, 130, 131, 221/155, 232; 194/1 R, 12

[56] References Cited

U.S. PATENT DOCUMENTS

| | | | |
|---|---|---|---|
| 744,673 | 11/1903 | Balsley | 221/232 X |
| 1,064,941 | 6/1913 | Thompson | 221/155 X |
| 1,616,251 | 2/1927 | Bookout | 221/232 X |
| 2,305,342 | 12/1942 | Fry | 221/130 X |
| 2,382,576 | 8/1945 | Pease | 221/232 X |
| 2,444,747 | 7/1948 | Niewdehner | 221/232 X |
| 3,722,745 | 3/1973 | Gushi et al. | 221/232 X |
| 3,753,514 | 8/1973 | Naguet | 221/129 |

*Primary Examiner*—F. J. Bartuska

[57] ABSTRACT

An advertising display assembly having a plurality of modular card holder-ejector units each having a specific ad, mounted in an easily viewable face of a display cabinet. Each modular card holder-ejector unit having a holder for a stack of advertising cards and a single card ejector, illuminated advertising space, and an actuating button for the card ejector. Each modular unit is arranged for a quick and easy plug-in type replacement of a module in the display cabinet.

9 Claims, 9 Drawing Figures

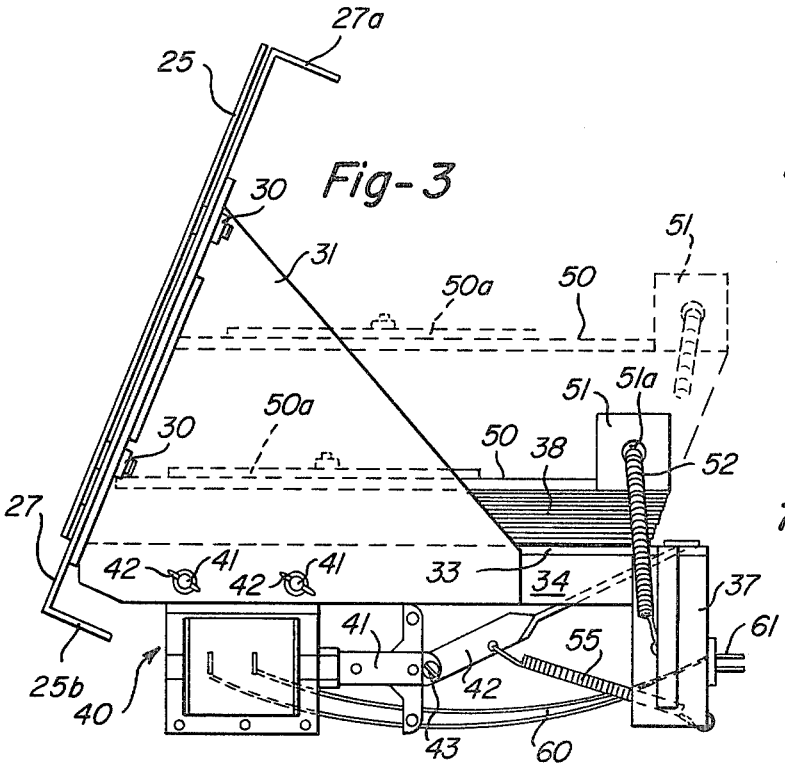
Fig-3
Fig-4
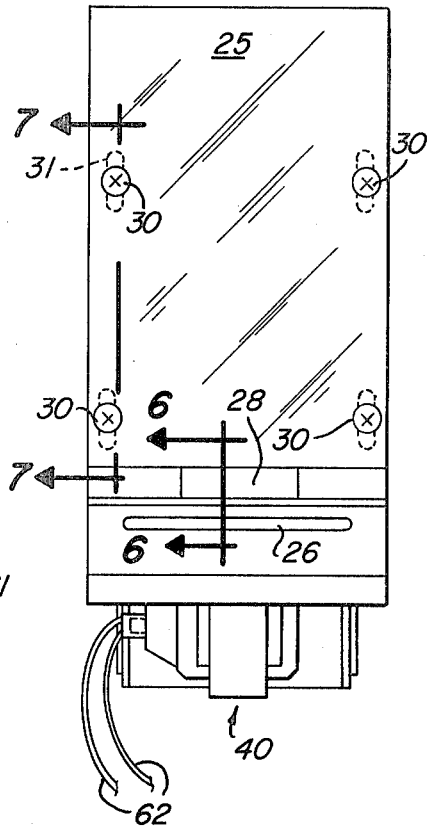
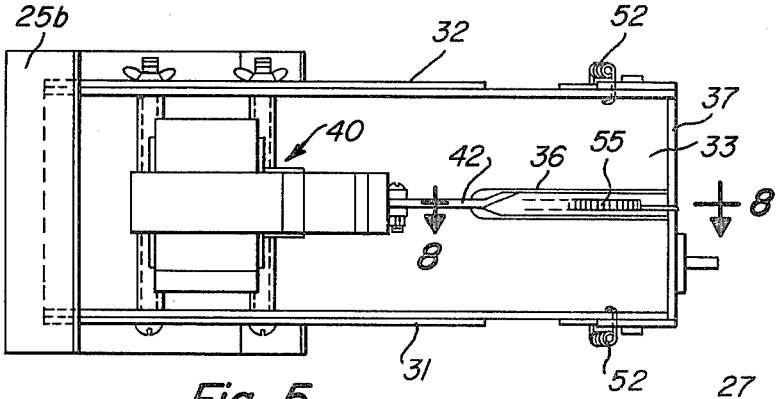
Fig-5
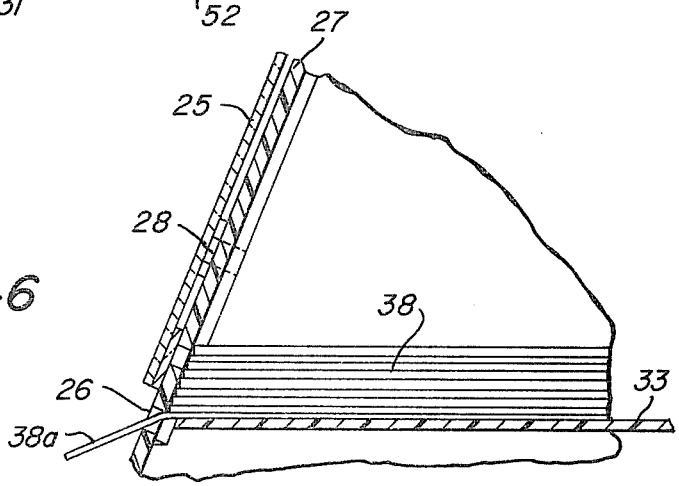
Fig-6

DISPLAY ASSEMBLY WITH CARD EJECTOR

The present invention relates to advertising systems of the type using a tie-in card, such as a discount card, for the goods or services of the specific advertiser.

It is generally conceded that advertising is more effective when the potential recipients of the advertising are given an incentive to use the goods of the services of the advertiser. Such incentives as coupons and discount cards tend to bring potential users to use the advertisers goods or to the advertiser's place of business. The actual placing of the physical objects of the incentive into the hands of the potential user presents a problem of logistics and distribution. Newspapers, magazines, etc. are fairly good for some types of coupons, but are not satisfactory for others, for example, for incentives for travelers to utilize motels, hotels, restaurants, etc. It would be ideal to provide a multiple display of available incentives for specific advertisers at locations of high traffic of persons desiring information and/or the incentives for such goods and services.

OBJECTS AND ADVANTAGES OF THE INVENTION

It is therefore, an object and advantage of the invention, to provide a plurality of advertising displays in a modular display array of advertisers, and a means to immediately provide customer incentives to viewers of the array.

Other objects include to provide a dispenser of cards or the like which is a single card dispenser and which is simple and inexpensive; such a dispenser is presentable in a modular unit with advertising for mounting in displays, billboards and the like, and is small and of light weight, and one which is arranged with a supply of cards in a stack.

Another object of the invention is to provide a single card dispenser with novel guide means for a single card from a stack of cards.

Yet another object of the invention is to provide a modular card holder-ejector unit having card display means and advertising display means visible to a user.

Still another object of the invention is to provide a card holder having a simple low card supply indicator means.

An addition object of the invention is to provide a card holder-ejector system having a simple touch button for dispensing cards.

A further object of the invention is to provide a modular card holder-ejector unit arranged as a plug-in unit in a multiple modular unit assembly.

These and other objects and advantages of the invention may be readily ascertained by reference to the following description and appended illustrations.

GENERAL DESCRIPTION OF THE ILLUSTRATIONS

FIG. 3 is a side elevational view of a modular card stack holder—single card ejector arranged to be mounted in a modular unit;

FIG. 4 is a front elevational view of the device of FIG. 3;

FIG. 5 is a bottom plan view of the device of FIG. 3;

FIG. 6 is an enlarged sectioned detail of the card ejecting slit of the unit of FIG. 3;

SPECIFIC DESCRIPTION OF THE ILLUSTRATIONS

Figure 1:
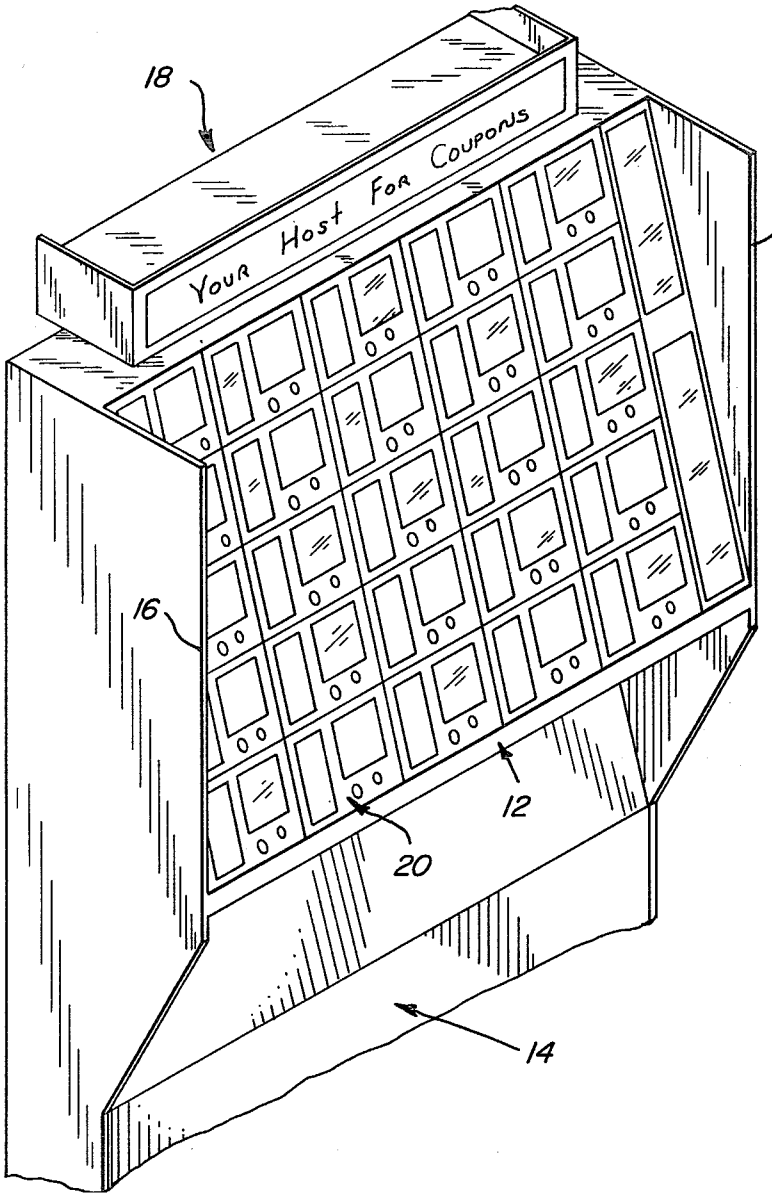
FIG. 1 is a perspective view of a display cabinet with a plurality of modular card stack holder-ejector units according to the invention.
Figure 7:
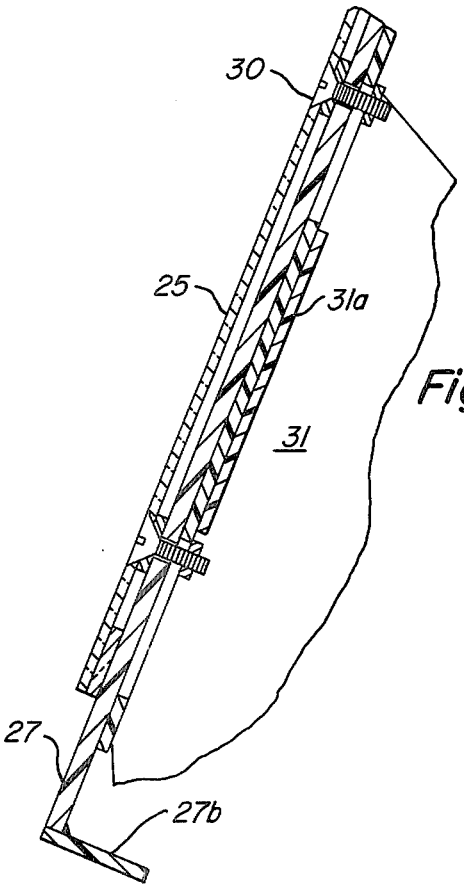
FIG. 7 is a cross-sectional, enlarged detailed view of a front panel of the card holder—ejector of the invention, taken along section line 7—7 of FIG. 4.
Figure 8:
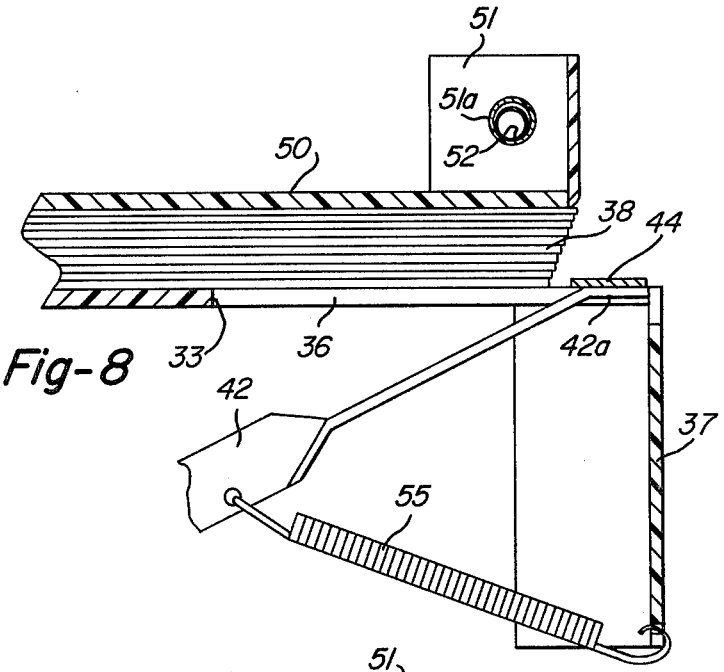
FIG. 8 is partial cross-section of an enlarged detail of the card holder and card ejector mechanism of the invention; and, FIG. 9 is a partial cross-sectional, enlarged detail of the card ejector of the invention in the position of ejecting a single card from a stack of cards.

In the embodiment selected for illustration in FIG. 1, there is shown a display unit of a plurality of modular card holder-ejector and advertising units are arranged in a cabinet for display at areas of high traffic of persons who have need of the goods or services of those advertising in the unit. For example, the unit may be highly useful in air terminals, bus and railway terminals, shopping malls, and the like, where a large number of persons are available for viewing the unit. These persons may easily find the cards they desire; such cards may be discount cards or coupons for various goods or services.

The unit, shown in general by a numeral 10, includes a display face, shown in general by numeral 12, in which a plurality of individual modules 20, shown generally by numeral, are secured. The module is described below. The cabinet unit is mounted on a base 14, shown generally by numeral, to correspond to the area in which it is placed. To keep stray light from the panel display face, wings 15 and 16 may be provided. Such wings also provide for unity of the cabinet and face. A display sign 18, shown generally by numeral, may be mounted on the top of the cabinet, identifying the owner or the service-representative for the unit.

Figure 2:
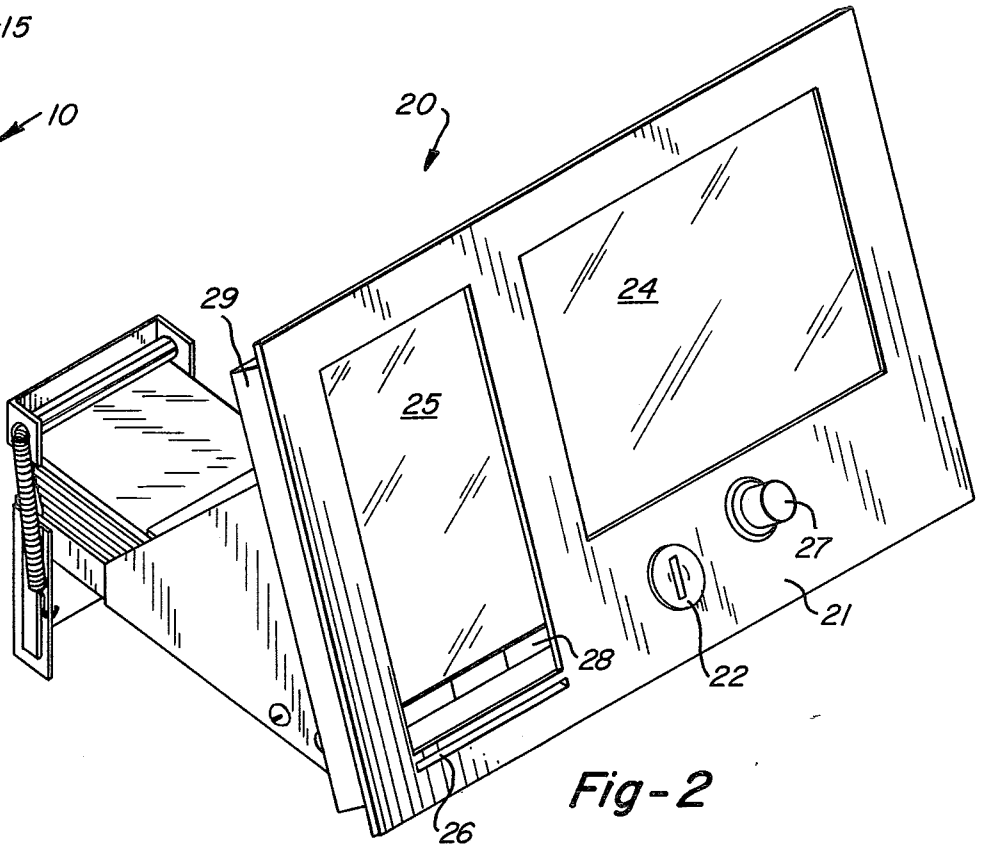
FIG. 2 is a perspective view of one form of a modular card stack holder—single card ejector unit and advertising panel, according to the invention.

Each modular unit 20, shown in FIG. 2, includes a face plate 21 which is arranged to be mounted in an opening of display plate 12 of the display unit 10. For convenience, a key lock 22 may be placed in the plate 21, so that the modular unit may be mounted in the display face 12 and secured by the lock. This provides a quick and easy installation and removal of the unit from the display. The face 25 includes an advertising display window 24, which provides means for holding an advertising placard. Such advertising may be translucent or transparent so that a light in the cabinet illuminates advertising for displaying it to a viewer. A second viewing window 25 provides means for displaying the card or coupon to be dispensed by the unit, and, of course, the card is a companion to the advertising placard in the window 24. Immediately below the window 25 is a slot 26 for the ejection of a single card from a stack maintained behind the faceplate 21. A touch button 23 is arranged in the plate to activate the card dispensing mechanism, as explained below. A space 28 in the window 25, below the display of a card in the window may be covered with a red, transparent film so that when the cards stacked behind the window 25 have been dispensed down to that area, the low level of the stack of cards may be ascertained, indicating that the card holder requires to be filled. The red film and its holder may, also, serve as a brace or a block for holding the sample display card being displayed in the window 25.

Such cards are normally opaque to light and the card stack is not visible through them.

The face plate 21 is generally rectangular in shape and of size and configuration to fit in a mating opening in a face plate 21 of the display unit 10. The face plate may be either plastic or metal. Extending inwardly from each side are flanges 29, only the flange on the left end is shown, which serves as mounting brackets for easy mounting in and to support the card holder and dispenser.

The card holder and dispenser is secured to the window 25, FIGS. 3–6, by means of bolts and nuts. The bolts 30, also, secure side plates 31 and 32 to the face. The sidewalls are generally triangular in shape with outstanding flanges 31*a* and 32*a* on sidewalls 31 and 32 each having slots 31*b* and 32*b* respectfully through which the bolts 30 pass so that the face plate 25 may be adjusted in relation to the sides and a card holding floor 33, so that the card ejecting slot 26 can be accurately positioned in relation to the floor. The plane of the front plate 25 is mounted at an obtuse angle to the plane of the floor 33. The floor 33 includes downwardly depending flanges 34 between which a solenoid, shown generally by numeral 40, is suspended by means of bolts 41 having wing nuts 42 thereon. Also suspended from the floor 33 is a black backplate 37. The floor of the cardholder is rigidly mounted on the sides and the front plate 25 so that the unit may be attached to a modular unit and be securely held for dispensing of cards. The top of the floor is preferably a highly polished and smooth surface to reduce the friction between held cards and the floor. A stack of cards 38 is mounted on the floor and pressed against the back of the front plate 25. The cards in the stack are held at an angle because of the sloping face plate.

To hold the cards in position on the floor 33 is a pressure plate 50, which is approximately the size of the cards to permit it to ride freely between the sidewalls of the dispenser. An upward projection 51 is arranged on the plate 50 to hold a spring 52 which is fastened to each side of the back wall 37. In some instances, it may be that a weighted plate is useful to help the spring hold the cards in position, and a weighted member 50*a* may be placed on the pressure plate and secured thereto. The metal weight is intended to hold flat any cards that may be curled or bent. The spring 52 is preferably a wrap-around spring, such that it passes through an opening 51*a* through the block 51 and is attached at both ends to the back plate 37. The spring mechanism thus holds the stack in place in the card holder and biases the holder towards the front wall. As shown in the fantom view of the higher stack, the spring is at an angle biasing the plate against the front wall, and as the cards are dispensed, the pressure plate is rounded to allow the ejector blade to easily pass under the pressure plate should the card holder become empty and the solenoid engaged.

Figure 9:
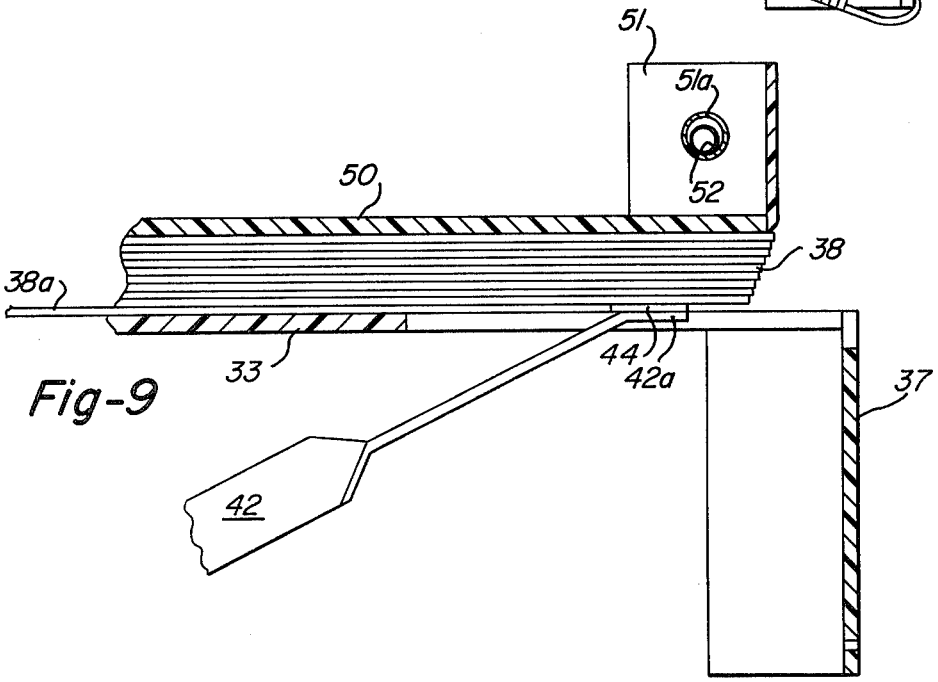

The solenoid 40 is provided with a plunger 41 on which is mounted a pivotal arm 42 by means of a screw and nut or a pivot pin 43. The T-shaped arm, which may be termed a stabilizer arm due to the lateral member at its end, is attached to the push-pull rod or armature 41 of the solenoid, and the arm is twisted to pass through the narrow slot and bent at an angle at its rear end 42*a*. A polished spring steel blade 44 is secured to the end of the arm and arranged to lie flat on the floor 33. The arm 42 extends through a slot 36 in the floor 33 and is arranged to ride freely in the slot so that the blade 44 travels flush on the floor and pushes a single card from the card stack 38 out through the opening 26, FIG. 6. A spring 55 attached to the arm 42 and the back plate 37 biases the blade and the arm in the out or cocked position, so that on activation of the solenoid, the plunger is drawn into the coil, drawing the arm along the slot 36. This pulls the blade 41 along the floor into contact with the rear edge of the lower most card. Further movement of the blade dispenses the same, as shown in FIG. 9, where the blade 44 has passed under the stack of cards pushing single card 38*a* forwardly. The blade 44 is arranged to the thickness of a single card to be dispensed, so that the blade movement engages only the rear edge of the bottom card, and does not push on the next higher card. The next higher card is held against the front plate so as not to follow the lower card by reason of the friction between them.

Power to the solenoid may be applied by means of a pair of power leads 60 secured to the pronged connector 61, which is arranged to engage a female receptacle (not shown) mounted in the display cabinet. This permits the unit to be easily inserted and detached from the cabinet without additional connection of wires. Of course, there must be one receptacle for each of the modular units. Leads 62, FIG. 4, extend to the actuator button 27 in the unit. The key controlled lock and the plug-in units provide quick and easy maintenance of the cabinet.

The assembly of a card holder and ejector permits it to be hung or mounted from any angle, since the cards are held by the plate against the floor and are pressed under spring tension against the floor plate. Normally, if the unit is hung from a vertical board, the dispenser floor is angled toward the ejection slot. The front plate face 27 of the ejector unit may be adjusted by means of the bolts 30 to slide the plate in relation to the floor 33, as shown in FIG. 6, so that the slot 26 is arranged to press a card downwardly when ejected therethrough, which permits the next higher card to bear against and be held by the front plate 27. This prevents the next higher card from being ejected along with the lower card which is being pushed by the blade 44. The blade thickness permits the unit to be adjusted for different thicknesses of cards or coupons. The precision blades may be varied in thickness, and since these are normally welded to the arm 42 of the unit, the stabilizer arm and blade may be easily interchanged. This is achieved by removing the pivot pin between the arm and the solenoid plunger and replacing the blade-arm with another. The width of the blades, also, may be changed to correspond with varying lengths of cards, and, of course, the combined blade and arm may be changed with the various widths of cards. The width of a card normally has little effect on the unit so long as the card is narrower than the side walls. Even though the cards are narrower than the side walls, the pressure plate maintains them in their entered position for easy dispensing through the slot. The configuration of the card holder and dispenser permits stacking and mounting a large number of cards in the holder. The cards may be easily replaced or the holder refilled, by flipping the pressure plate rearwardly, generally pivoted on the spring, placing a stack of cards in the holder and then rotating the pressure plate back forwardly. The plate is held flat on the stack, and the spring biases the pressure plate against the sloped front, holding the stack of cards tightly against the front plate and against the floor plate.

The card-holder-dispenser may be made of a size and shape to correspond to a particular card, and the display unit face plate may have openings which are arranged to mate with the front plate of the individual modular unit. Thus, it is not necessary that the openings in the face 12 of the unit 10 be of the same size, but they may be made to correspond to the particular card dispensing unit. In addition, the modules need not have an actuator button as such, but a coin accepting actuator unit may be used either for an individual module or for all modules in the unit, with an actuator button for each module. This permits a single button to operate when coins of the proper denomination have been entered into the coin acceptor. The use of the coin operated dispenser does not change the over all configuration but merely provides a means of applying actuating power to the solenoid.

The arrangement described utilizes a single puller arm for the card contacting plate which passes through a narrow slot. This provides guiding and stabilizing for the pusher blade in a consistent, central position. Also, the spring on the stabilizer arm biases the arm downwardly, holding the blade flush against the floor insuring proper contact with only the bottom card. In place of the single arm, a yoke on the solenoid armature would utilize two arms secured to the ends of the blade. These two arms could be mounted in slots or on the edge of the floor, permitting a full width blade.

While the invention has been described with reference to specific embodiments, the concept of the invention is not limited to the precise details so set forth, except as defined in the following claims.

What is claimed is:

1. An advertising display cabinet for multiple units each with its own advertising display comprising:

(a) housing means providing a planar display panel and being otherwise closed;

(b) said display panel having a plurality of openings and plug in electric connection means at each said opening;

(c) a complete modular unit including cover means for each of said plurality of openings formed as a replaceable module including electric connection means for connection with said plug in electric connection means;

(d) generally horizontal floor means for supporting a stack of cards, said floor means being planar and smooth to provide low friction between a card and the floor, and provided with a narrow slit adjacent the rear edge of the floor;

(e) side wall means projecting upwardly from opposed edges of said floor means closely supporting a stack of cards therebetween;

(f) adjustable front panel means forming with said floor means an adjustable card ejector slot being adjustably secured to said side wall means;

(g) means adjustably securing said front panel means to said side wall means, providing a height adjustment of said card ejector slot in relation to said floor means;

(h) slide plate means of the thickness of a card of said stack cards reciprocably mounted on said floor means and having an actuator arm means extending through said narrow slit, said slide plate means mounted at rest at a position spaced from said stack of cards;

(i) said actuator arm means mounted beneath said floor means and connected with said slide plate means for reciprocating said slide plate means including a wide portion mounted in said slit so as to prevent turning said arm means;

(j) push-pull means connected to said actuator arm means for reciprocating said actuator arm means forwardly and rearwardly;

(k) spring biased pressure means for a stack of cards on said floor means holding said stack of cards biased against said floor means and against said front panel means;

(l) actuating means for said push-pull means for reciprocating said actuating arm means and said slide plate for pushing the lower most card from the stack to extend through said card ejector slot;

(m) display means in each said cover means for identifying the information on the cards dispensed by each said single card dispenser whereby each modular unit is a complete replaceable unit, and (n) each said complete modular unit including low card level indicator means in said cover means for determining a low quantity of cards in each said single card dispenser means.

2. A holder-ejector according to claim 1, wherein said front panel means includes panel means for mating in an opening in a display cabinet.

3. A holder-ejector according to claim 1, wherein said front panel means includes a transparent window for advertising means and display means for one of the stack of cards.

4. A holder-ejector according to claim 1, wherein said push-pull means for reciprocating said actuator arm means includes a solenoid.

5. A holder-ejector according to claim 4, wherein a spring biases said actuator arm means rearwardly with said slide plate means in a non-contact position with said stack of cards.

6. A holder-ejector according to claims 2, 3, 4 or 5, wherein said spring biased pressure means includes a plate for resting on a stack of cards and a spring is secured to the rear of said plate and to a point adjacent the rear of said floor means for biasing said plate forwardly against said front panel means and downwardly against said floor means.

7. A holder-ejector according to claims 2, 3, 4, or 5, wherein said front panel means is mounted at an obtuse angle toward the plane of said floor means.

8. An advertising display cabinet according to claim 1, wherein each said cover means includes a transparent glass window arranged to hold translucent advertising means.

9. An advertising display cabinet according to claim 1, wherein said single card dispensing means includes a solenoid actuator secured to a single card contactor, and said actuating means is mounted in said cover means and includes a touch button exposed for use at the front of said cover means and connected with said solenoid.

* * * * *